US005584268A

United States Patent [19]

Natkin et al.

[11] Patent Number: 5,584,268

[45] Date of Patent: Dec. 17, 1996

[54] LOW INERTIA ROCKER ARM WITH LASH ADJUSTER AND ENGINE VALVE

[75] Inventors: Robert J. Natkin, Allen Park; Douglas D. Cantrell, Jr., Ann Arbor, both of Mich.

[73] Assignee: Ford Motor Company, Dearborn, Mich.

[21] Appl. No.: 364,330

[22] Filed: Dec. 27, 1994

[51] Int. Cl.[6] ..... F01L 1/18; F01L 1/24

[52] U.S. Cl. ..... 123/90.46; 123/90.58

[58] Field of Search ..... 123/90.39, 90.41, 123/90.42, 90.43, 90.44, 90.45, 90.46, 90.55, 90.58

[56] References Cited

U.S. PATENT DOCUMENTS

| | | | |
|---|---|---|---|
| 2,053,743 | 9/1936 | Russell | 123/90.46 |
| 2,071,051 | 2/1937 | Ranst | 123/90.46 |
| 4,104,996 | 8/1978 | Hosono et al. | 123/90.46 |
| 4,192,263 | 3/1980 | Kitagawa et al. | 123/90.46 |
| 4,502,428 | 3/1985 | Paar | 123/90.46 |
| 4,779,583 | 10/1988 | Laffter et al. | 123/90.58 |
| 4,815,424 | 3/1989 | Buuck et al. | 123/90.46 |
| 5,107,806 | 4/1992 | Dohring et al. | 123/90.58 |
| 5,353,756 | 10/1994 | Murata et al. | 123/90.46 |

FOREIGN PATENT DOCUMENTS

| | | | |
|---|---|---|---|
| 2039975 | 2/1972 | Germany | 123/90.46 |

*Primary Examiner*—Weilun Lo
*Attorney, Agent, or Firm*—Jerome R. Drouillard

[57] ABSTRACT

An automotive type engine valvetrain rocker arm is constructed with a hydraulic lash adjusting assembly, with the mass of the adjusting assembly being closely adjacent the pivot axis of the rocker arm to minimize the rotational moment of inertia of the rocker arm.

6 Claims, 6 Drawing Sheets

LOW INERTIA ROCKER ARM WITH LASH ADJUSTER AND ENGINE VALVE

FIELD OF THE INVENTION

This invention relates in general to an automotive type engine valvetrain, and more particularly, to the design and construction of a rocker arm for actuating one or more valves of the engine.

BACKGROUND OF THE INVENTION

Hydraulic valvetrain lash adjusters are known for compensating for wear or growth between various parts of the valvetrain. U.S. Pat. No. 5,107,806 to Dohring et al. is an example of an automatic hydraulic valve-clearance compensating element in which a pair of piston elements are relatively moveable to provide for extension or contraction between the parts.

In many cases, the lash adjusting unit, if contained within a rocker arm, is located at the end of the rocker arm opposite the end containing the pivot shaft. This is a disadvantage because the farther the assembly is from the pivot shaft, the greater the moment of inertia of the lash adjusting mass, which results in greater stress on the parts and parasitic losses in the engine.

Valve deactivators are also known for disabling the movement of one or more of the valves of the engine during low power or torque periods, for economy purposes. The known devices, however, are generally complicated and costly, having many parts, and often require, for example, splitting the camshaft or crankshaft or declutching the rocker arm to render it inoperative to move the valve stem.

The invention provides a simplified construction of a single rocker arm that encloses both a hydraulic lash adjuster as well as a valve deactivator, integrated in a manner to minimize the rotational moment of inertia of the mass of the rocker arm.

SUMMARY OF THE INVENTION

The invention provides a single unitary rocker arm construction that includes a wear or growth compensating hydraulic lash adjuster mounted within the rocker arm in a manner minimizing the rotational moment of inertia of the rocker arm. The lash adjuster has a cam actuated piston defining a high pressure chamber, and also a low pressure reservoir. The two are separated by a ball type check valve to control pressurization of the high pressure chamber or replenishment of fluid to it, for lengthening or shortening the stroke of the piston.

In a modified embodiment, the lash adjuster assembly is mounted within the rocker arm in a sleeve or cartridge-like housing that can move relative to the rocker arm against a spring bias to at times cancel out movement of the rocker arm and thereby interrupt valve actuation. At other times, the housing can be rigidly locked to the rocker arm for valve actuation.

Both the housing with enclosed lash adjusting assembly and the valve deactivator are closely clustered within the rocker arm adjacent its pivot axis to minimize the rotational moment of inertia of the masses.

In a further modification, the single rocker arm is constructed to selectively actuate one or more of a pair of engine valves.

It is a primary object of the invention, therefore, to provide an automotive type engine valvetrain rocker arm construction and operation that integrates both a hydraulic lash adjuster and/or an engine valve motion disabler or deactivator within the rocker arm closely adjacent the rocker arm pivot axis to minimize the rotational moment of inertia of the arm.

It is a further object of the invention to provide a single rocker arm of the type described above that actuates a pair of engine valves, the rocker arm having bifurcated portions within each of which is contained a hydraulic lash adjuster and/or a valve deactivator, each being independently operable.

Other objects, features and advantages of the invention will become more apparent upon consideration of the succeeding, detailed description thereof, and to the drawings illustrating the preferred embodiments thereof.

DETAILED DESCRIPTION OF THE INVENTION

Figure 1A:
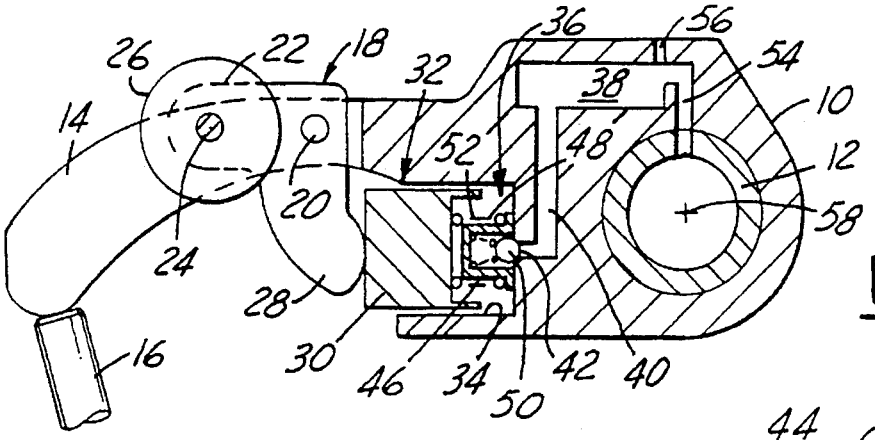
FIG. 1A is a cross-sectional view of an engine rocker arm embodying the invention.

FIG. 1A is a cross-sectional view of a one-piece automotive type engine rocker arm 10. It is rotationally mounted at one end on a pivot or rocker shaft 12. At its opposite end, it has a finger-like portion 14 engageable with a portion of the stem 16 of an engine valve, not shown.

The rocker arm is adapted to be actuated in a conventional manner by a cam fixed, in this particular instance, on an overhead camshaft, not shown. For this purpose, a pivot lever 18 in the shape of a bell-crank is pivoted at 20 to the rocker arm body. One arm 22 is pivotally attached at 24 to a roller 26 engageable by the aforementioned camshaft cam. The opposite end arm 28 is adapted to engage the piston 30 of a hydraulic lash adjuster assembly 32.

The assembly is nestedly received within a recess 34 in the rocker arm body for a slight sliding movement relative to the body to accommodate or compensate for lengthening or contracting/shortening of the travel of pivot arm 28 due to wear or growth or volume changes in the abutting engine valvetrain parts.

More specifically, the piston 30 has a sliding fit within the recess 34 to provide an essentially sealed high pressure chamber 36. The chamber is spaced or separated from a low pressure reservoir 38 but connected to it by a passage 40 and a port 42 opening into the chamber. The latter port is adapted to be closed by a one-way check valve assembly. It includes a spring retaining housing 46, and a light weight spring 48 biasing a ball valve 50 to close port 42. A further heavier spring 52 biases the piston 30 outwardly to the left as seen in the figure against or into contact with the pivot arm portion 28. Any slight leakage of fluid or oil through the clearance space between the piston 30 and the rocker arm will flow into the engine cylinder head area.

The reservoir 38 in this case is supplied with a low pressure fluid from the center of the rocker arm pivot shaft 12 through a connecting channel or passage 54. This maintains the reservoir 38 at a cylinder head pressure level of say, 30–50 psi, for example, regardless of the pressure changes caused by movement of the piston 30 in a manner to be described. An air bleed 56 permits venting of air bubbles from the reservoir.

In operation, rotation of the camshaft cam off its base circle in a known manner will cause roller 26 to move downwardly as seen in FIG. 1A moving the pivot arm 28 counterclockwise to actuate piston 30 against its spring 52. The ball valve already being seated causes an immediate increase in pressure level in chamber 36, to, for example, 8000 psi, and essentially provides a rigid connection between the pivot arm 28 and the rocker arm as a whole to pivot the rocker arm about axis 58 in a counterclockwise direction to move the valve stem 16 downwardly to open the valve.

When the camshaft cam rotates from its high point towards its base circle, the strength of the engine valve return spring (not shown) acting on stem 16 will pivot the rocker arm in a clockwise direction. The piston return spring 52 will maintain an outward push or force on pivot arm 28 to keep the roller 26 in contact with the cam. If for some reason the valve stem 16 and, therefore, the finger 14, should not rise to its valve closed position, due to wear shrinkage or other changes in the parts of the valvetrain, the changes will be accommodated by the lash adjuster.

The pivot arm 28 will press against the piston 30 and compress spring 52 slightly. This will force oil from the high pressure chamber through the tight clearance between the piston outer diameter and the rocker arm, which will allow the volume in chamber 36 to decrease. Growth or other conditions moving the valve stem slightly downwardly upon valve closure also causes pivot arm portion 28 to move clockwise, with the roller abutting the cam, in an attempt to move away from piston 30. However, the piston return spring 52 will move the piston outwardly to maintain contact between the piston and pivot arm. The ball valve 42 will then unseat and makeup fluid from the reservoir then will enter the chamber until the volume increase produces a pressure in chamber 36 sufficient to permit the ball valve spring 48 to again seat the ball and seal off the high pressure chamber.

Figure 1B:
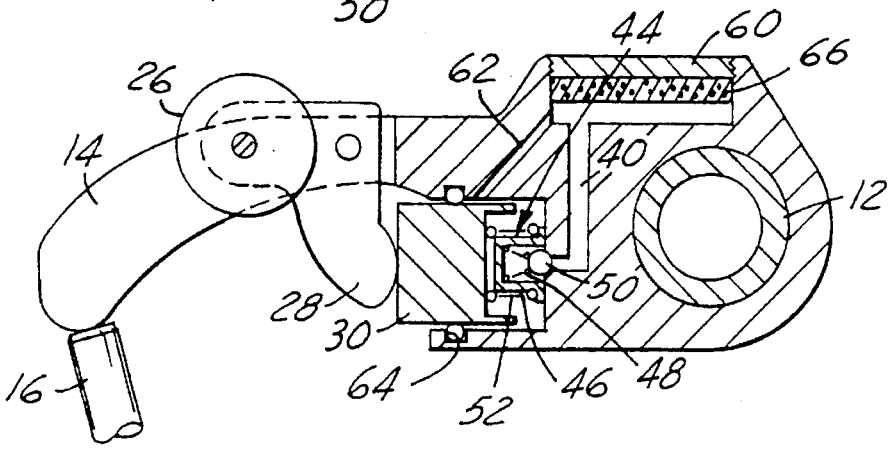
FIGS. 1B–1I are cross-sectional views similar to that of FIG. 1A illustrating modificational embodiments of the invention.

FIG. 1B shows a modification in which the lash assembly is self-contained. In this case, the piston 30 is slidably sealed within the rocker arm by means of an O-ring 64. The low pressure reservoir 38 is sealed with a cover 60 and connected by the fluid makeup passage 40 to the high pressure chamber 36. A fluid drainage or vent passage 62 is also connected to the tight clearance space 53 that seals the high pressure chamber. Reservoir 38 contains a closed cell deformable gas spring type foam member 66 that is initially installed under a low 3–5 psi pressure level to slightly compress the same. As the piston 30 initially moves rightwardly by cam action, as seen in FIG. 1B, there will be a slight leakage of fluid through the sliding clearance between the piston and rocker arm from the high pressure chamber. This passes through drain passage 62 into reservoir 38. This will slightly compress the gas spring foam 66, thus allowing the reservoir to compensate for any increase in volume of fluid.

It will be noted in FIG. 1A that the masses of the oil reservoir 38 and the hydraulic lash adjuster assembly 32 are concentrated close to the rocker arm pivot axis 58, which minimizes the rotational moment of inertia of the rocker arm assembly as a whole.

Figure 1C:
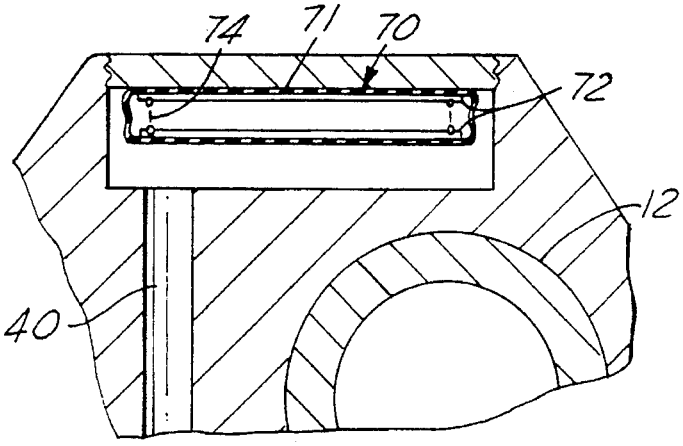

FIG. 1C shows still another modification in which a spring loaded diaphragm assembly 70 is installed in one-half of the sealed low pressure reservoir 38. In this case, the diaphragm assembly consists of deformable membrane 71 enclosing two stiff or rigid plates 72 biased apart by a spring 74. This permits the assembly to contract or expand as needed under the pressure/volume changes to maintain a low pressure level in the reservoir.

Figure 1D:
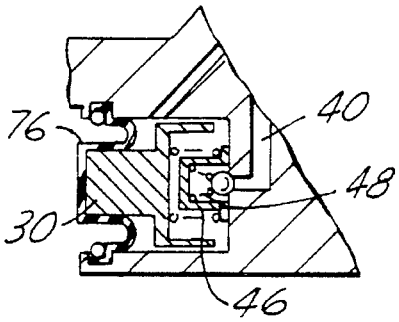

FIG. 1D shows how the piston 30 may be sealed to the rocker arm by means of an expandable bellows 76, in contrast to the O-ring seal shown in FIGS. 1B and 1C. Otherwise, the details of construction and operation remain the same.

Figure 1I:
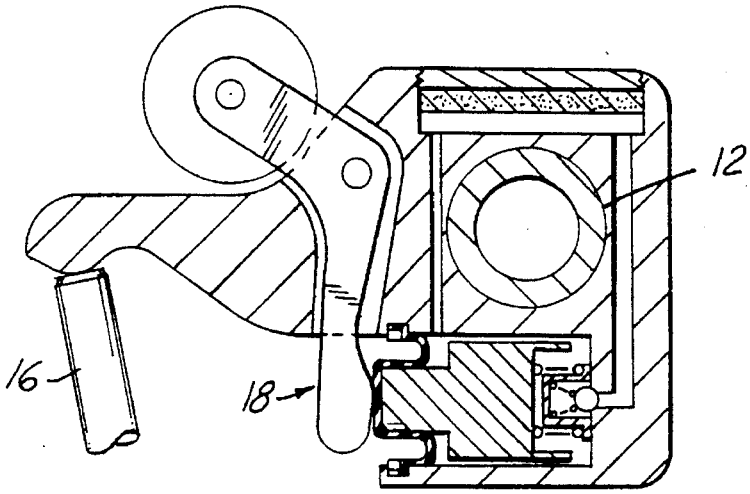
Figure 1E:
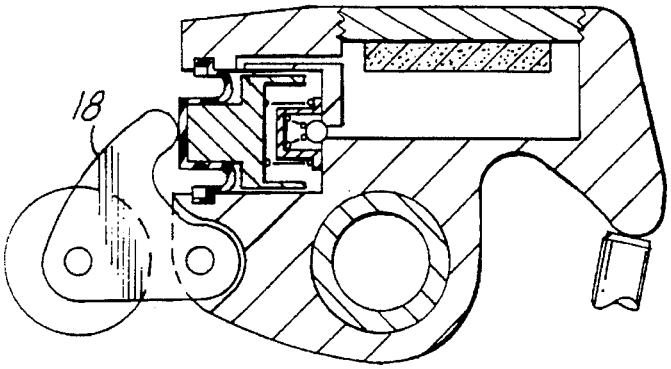
Figure 1F:
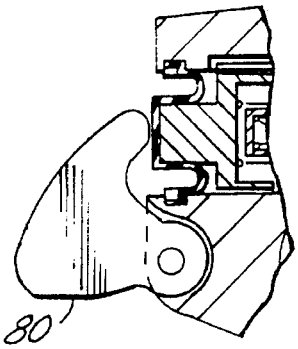

FIGS. 1E through 1H indicate different ways in which a center pivoted rocker arm can be actuated. In FIG. 1E, the lash adjuster assembly and reservoir can be located above the pivot axis and the pivot arm 18 located horizontally with a roller follower attached. FIG. 1F shows the pivot arm as having a cam slider follower pad 80 engageable by the cam.

Figure 1G:
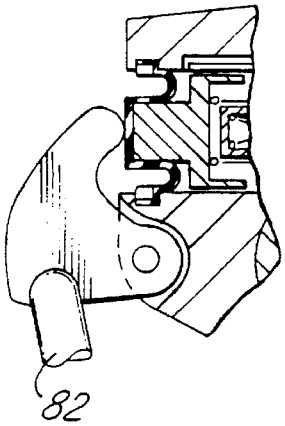
Figure 1H:
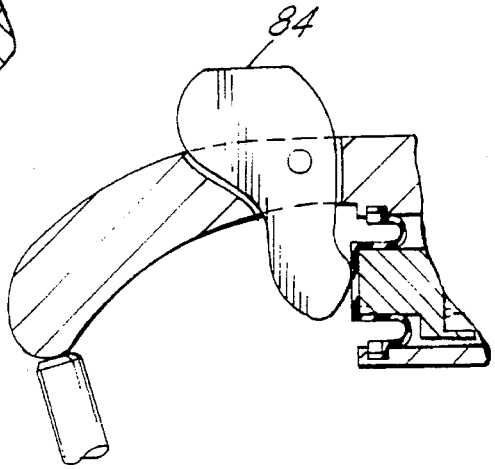

FIG. 1G shows the pivot arm being actuated by a push rod 82, whereas FIG. 1H shows the pivot arm with a camshaft slider follower pad 84 on its upper surface.

FIG. 1I illustrates a configuration in which the self-contained lash adjusting assembly and its reservoir straddle the rocker arm end pivot shaft 12 for minimal roller finger follower width and concentration of the mass of the components around the pivot axis in a radial-like manner.

Figure 2A:
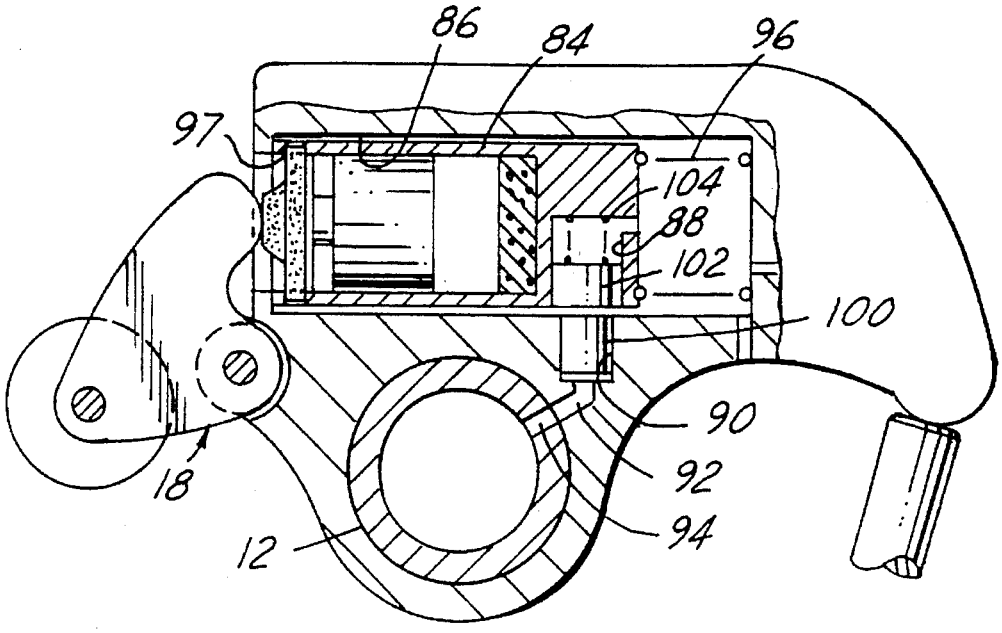
FIG. 2A is a cross-sectional view of an engine rocker arm constructed according to another embodiment of the invention.
Figure 2B:
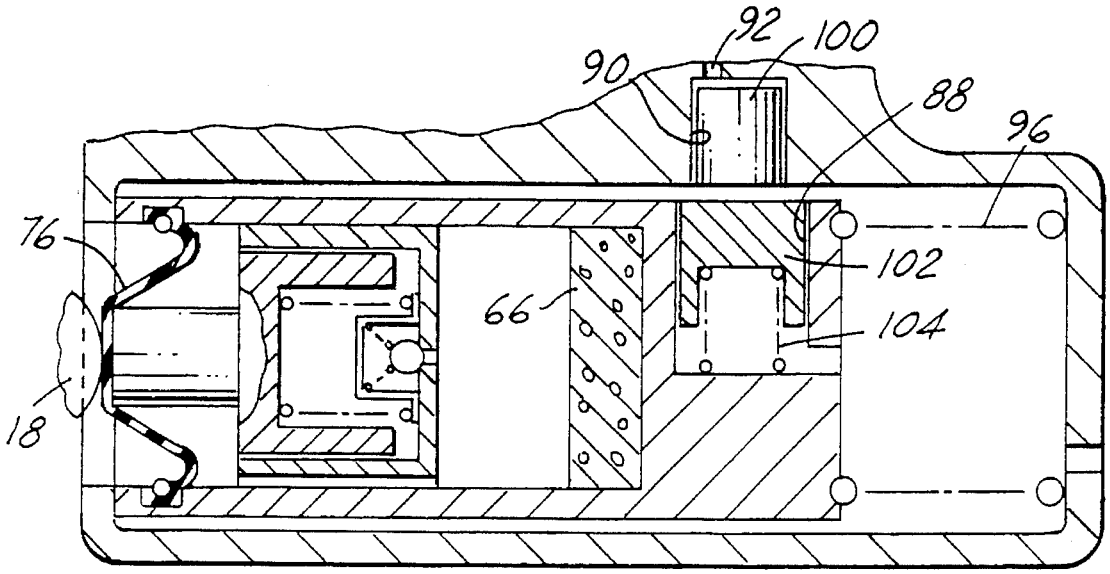
FIG. 2B is an enlarged portion of a detail of FIG. 2A.

FIGS. 2A and 2B illustrate a construction in which the rocker arm not only has a self-contained lash adjuster, but also incorporates a mechanism for selectively and temporarily terminating the opening and closing movements of the engine valve stem at times by disabling the movement of the rocker arm.

More specifically, the lash adjuster assembly is enclosed within the front end of a hollow cartridge-like housing 84 that is slidably movably retained in a recess 86 in the rocker arm. The rearward portion of the assembly contains a bore 88 that is adapted to be aligned at times with a mating bore 90 in the rocker arm body. The latter is supplied with fluid under pressure at times by a passage 92 connected to the center of the rocker arm pivot shaft 12. The hollow interior of the shaft is adapted to be connected to a source of fluid under pressure (not shown) through, in this case, an opening 94.

As best seen in FIG. 2A, the housing 84 can be moved rightwardly at times as a whole by the pivot arm 18, as seen in the Figure, within the rocker arm recess 86. A lost motion type spring 96 biases the housing in the opposite direction against a shoulder 97 of the rocker arm.

Although a single locking pin with a spring retaining flange could be used to enter or be withdrawn from the recesses 90,88 to lock/unlock the housing 84 and rocker arm, each of the recesses 90 and 88 in this embodiment contains a piston 100,102. The pistons together in effect constitute a two-piece locking pin. The piston 102 is biased outwardly by a spring 104. Fluid pressure admitted to passage 92 from the rocker shaft moves the pistons inwardly in the opposite direction.

The two pistons 100,102 in this case are of different diameters with smooth bearing surfaces on their adjacent faces. If the outer piston 100 is smaller in diameter, for example, application of fluid pressure in passage 92 would push the smaller piston in against the larger piston to a position where it would overlap both the rocker arm body portion and the housing recess 84. In this case, the housing would be locked to the rocker arm and any movement of the pivot arm would transmit movement directly to the rocker arm to pivot the same and open or close the engine valve.

Upon removal of the fluid pressure from passage 92, spring 104 would move the pistons 100, 102 outwardly. However, since the diameter of the piston 102 is larger than that of the piston 100, it can not enter the bore of piston 100. Therefore, the housing 84 is free to slidably move the pistons laterally relative to one another by moving the cartridge housing against lost motion spring 96, without moving the rocker arm or the valve stem 16. Thus, the rocker arm is in effect deactivated or disabled and the opening and closing movements of the engine valve interrupted.

Conversely, it will be clear that if the outer piston is larger in diameter than the bore of piston 102, the opposite operation will occur, the unit being normally locked to the rocker arm, in absence of fluid pressure, and unlocked when fluid pressure is applied to push the smaller piston into the cartridge recess 88.

Again, it is to be noted that the mass of the lash adjuster and housing and deactivator are concentrated closely adjacent the pivot axis to minimize the rotational moment of inertia of the integrated rocker arm unit.

The lash adjuster assembly per se again consists of a high pressure chamber separated from the low pressure reservoir by a ball check valve assembly. However, in this case, the chamber and reservoir are integrated as shown in a compact manner to fit within the cartridge housing 84. Both the chamber and reservoir are sealed, the reservoir in this case containing the gas spring closed cell foam member described earlier. Alternatively, the spring loaded diaphragm 70 shown in FIG. 1C could be substituted for the foam member 66, and lip seals or O-ring seals for the bellows seal 76 shown, all without departing from the scope of the invention.

Figure 3A:
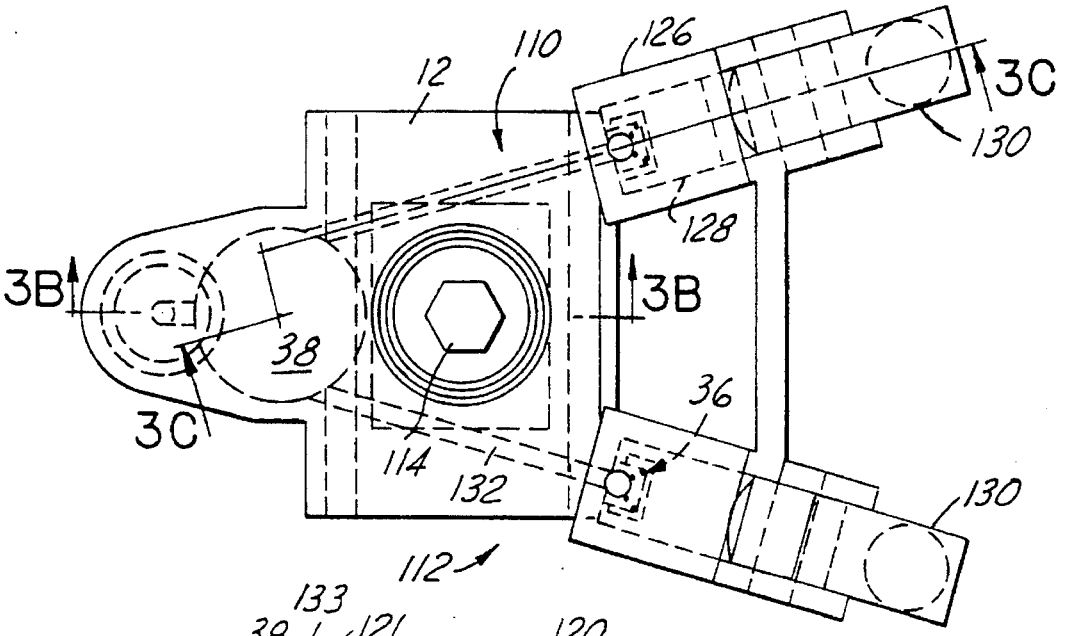
FIG. 3A is a plan view of a rocker arm with dual valve actuating portions embodying the invention.
Figure 3B:
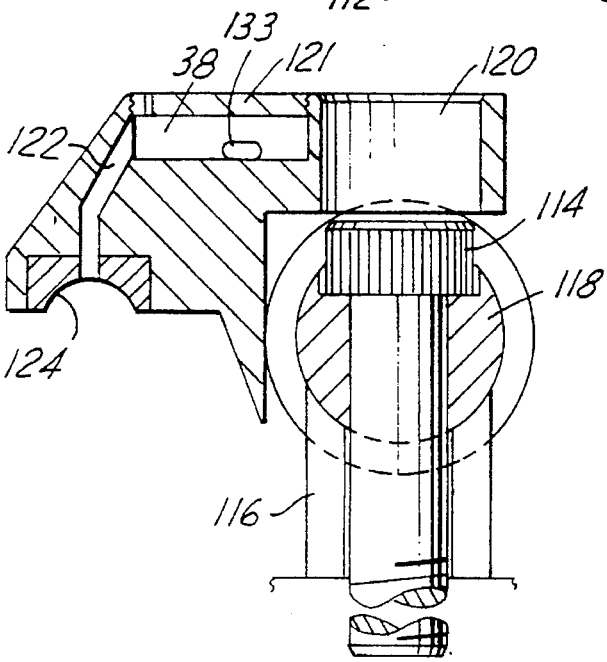
FIGS. 3B and 3C are cross-sectional views taken on planes indicated by and viewed in the direction of the arrows 3B—3B and 3C—3C, respectively, of FIG. 3A.

FIG. 3A illustrates a construction in which a single rocker arm can actuate two engine valves. The rocker arm in this case has essentially identical bifurcated portions 110,112. The rocker arm body is essentially center mounted by means of a bolt 114 (FIG. 3B) securing a pedestal type mount to the cylinder head of the engine. The mount includes a roller fulcrum shaft 118 for an arcuate pivotal movement of the rocker arm. An opening 120 in the upper body portion of the rocker arm accommodates installation of the bolt. This upper body portion also contains the low pressure reservoir 38, closed by a cover 121. In this case, the reservoir is connected by a passage 122 to engine oil under pressure from the spherical-like socket 124 that receives a hollow oil carrying push rod, not shown.

Each of the bifurcated portions 110,112 contains the annular cartridge-like hollow housing 126 with the forward portion defined by the cavity 128 containing the self-contained lash adjuster with its high pressure chamber and reservoir. The rearward portion of the housing is yoke shaped and contains one cylindrically shaped end of a bell crank-like pivot lever 130, the opposite end of which is spherically shaped and abuts the valve stem for control of movement of the valve.

Figure 3C:
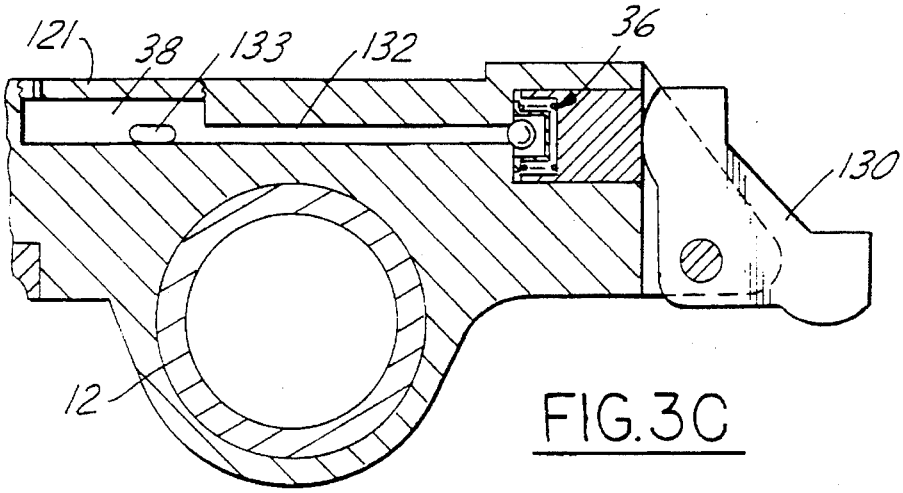

The high pressure chamber 36 and low pressure reservoir 38 in this case are located on opposite sides of the pivot axis, as seen in FIG. 3C. The two are connected by fluid passages 132 and 133 intersecting the reservoir. It will be seen, therefore, that the high pressure chamber and reservoir surround the rocker arm pivot axis so that the rotational moment of inertia of the mass of the rocker arm is minimized.

The details of construction and operation of the high pressure lash adjusting chamber and that of the spaced reservoir 38 are essentially the same as previously described in connection with the embodiments of FIG. 1 and, therefore, are not repeated. Again, it should be noted that the reservoir 38 can be an unsealed unit supplied with a low pressure fluid supply, such as in this case, with engine oil under pressure from the push rod socket, or can be a self-contained unit, sealed with a gas spring closed cell foam member or spring loaded diaphragm, all of which being previously described. Likewise, while the high pressure piston is shown as solely being sealed by a tight clearance within the body of the rocker arm for sealing purposes, additional sealing the piston by means of a lip seal, O-ring or bellows to make it a self-contained system could be used without departing from the scope of the invention.

Figure 3D:
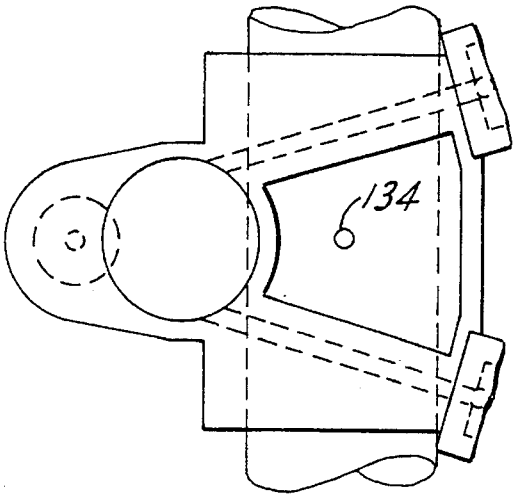
FIGS. 3D–3E are partial views similar to those shown in FIGS. 3A–3C illustrating modificational embodiments of the invention.
Figure 3E:
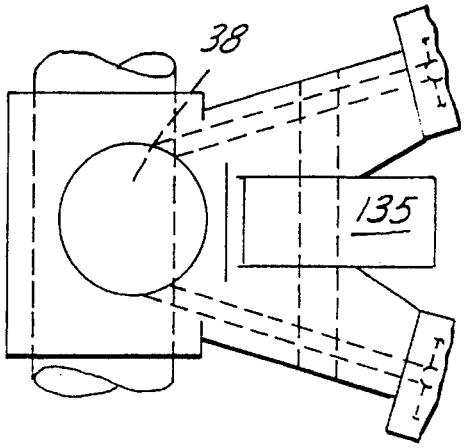

FIG. 3D shows the rocker arm shaft as having an oil splash and drainage hole 134 for lubricating the rocker arm shaft. FIG. 3E shows an end pivoted dual actuating rocker arm. The cam actuated finger follower roller 135 is located between the bifurcated portions and the reservoir 38 located directly above the rocker shaft.

Figure 4A:
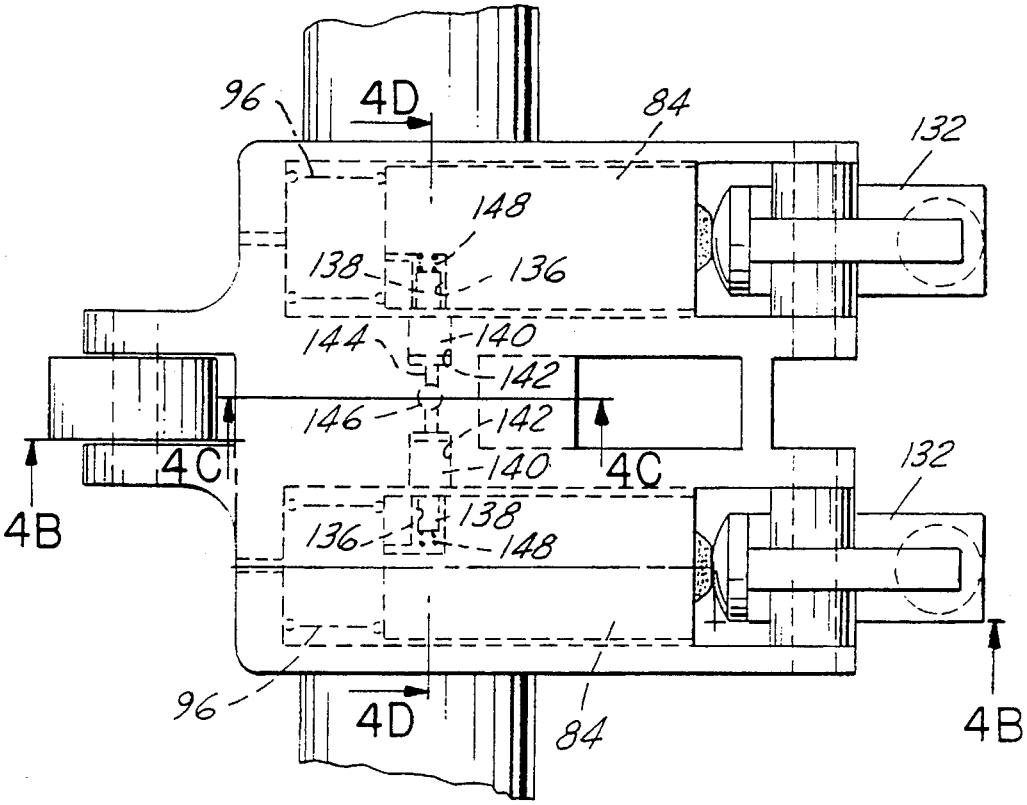
FIG. 4A is a plan view of a rocker arm construction embodying the invention with a pair of self-contained hydraulic lash adjusters in combination with engine valve deactivators.
Figure 4B:
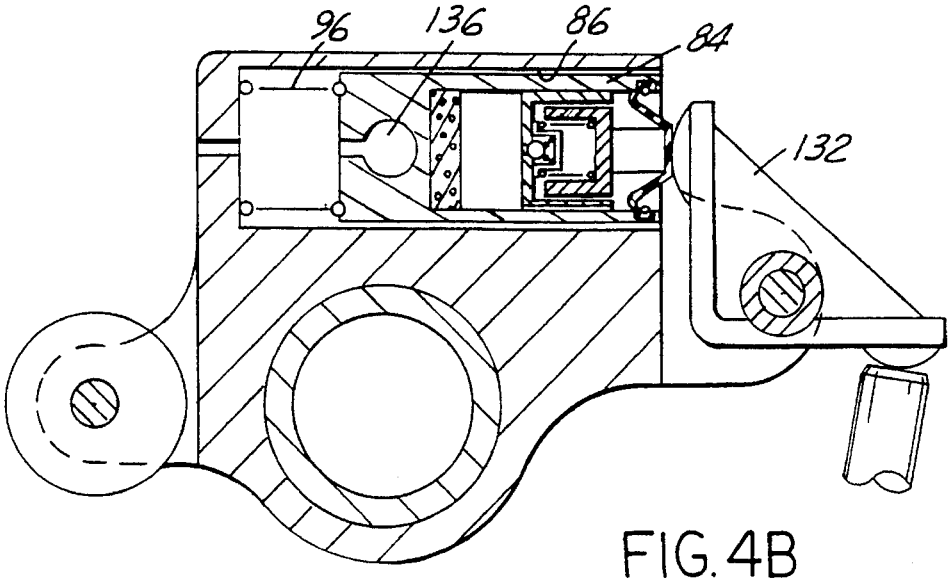
FIGS. 4B–4D are cross-sectional views taken on planes indicated by and viewed in the direction of the arrows 4B—4B,4C—4C,and 4D—4D, respectively, in FIG. 4A.

FIG. 4A is a plan view and FIG. 4B a cross-sectional view of another embodiment of a single rocker arm actuating two engine valves again by means of bifurcated portions. The construction is similar to that described in connection with FIGS. 2A–2C in that the lash adjusting assembly is self-contained. It is enclosed within a cartridge-like housing 84 that is slidably movable within the rocker arm recess 86 against a lost motion spring 96, as seen in FIG. 4B.

Figure 4C:
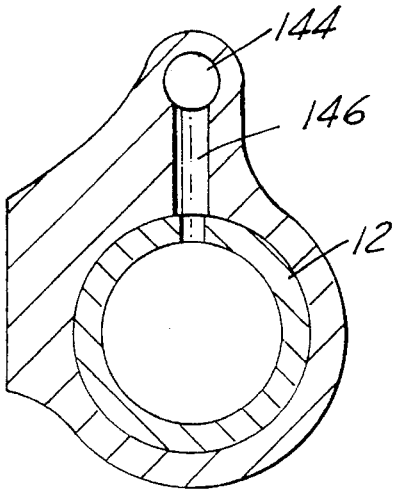
Figure 4D:
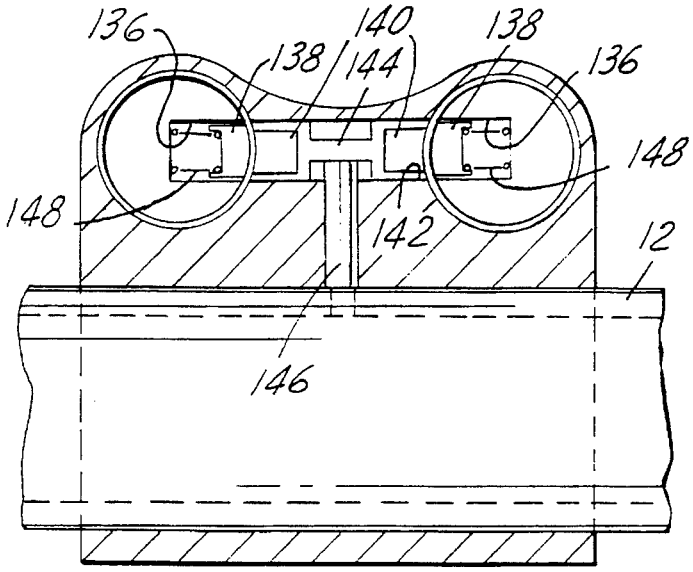

The housing of each bifurcated portion is provided with a bore 136 at its rearward end whose axis is at right angles to the longitudinal axis of the housing. The bore contains a spring biased piston 138 and is adapted to be aligned with a piston 140 in a mating bore 142, as seen in FIG. 4D, in much the same manner as in FIGS. 2A,2B. The mating bores align the cooperating pistons in a back-to-back relationship with respect to the two bifurcated assemblies. The outer piston bores are interconnected by a common passage 144 that is intersected by a supply bore or channel 146. The latter feeds fluid under pressure from the rocker arm shaft 12 as seen in FIG. 4C.

It will be noted that each of the pair of lash adjusters will independently adjust for wear, etc., with respect to its respective valve. Also, each valve deactivator or disabler can be independently controlled so that each of the engine valves actuated by the rocker arm can be controlled individually and independently of the other to provide joint movement of both, individual movement of one and not the other, or an interruption of the movement of both.

This can be accomplished by providing different spring rates for each of the deactivator piston return springs 148 for each assembly. For example, if the two springs are of different calibrations, then application of the oil under pressure at different pressure levels will operate them at different times permitting locking one of the lash assemblies to the rocker arm and not the other, to disable one valve operation.

From the foregoing, therefore, it will be seen that the invention provides a rocker arm construction that is compact and simple in design and operation, and yet provides an automatically operated hydraulic lash adjusting assembly as well as a mechanism for interrupting the engine valve actuation, both of which are located closely adjacent the pivot axis of the rocker arm shaft for minimizing the rotational moment of inertia of the rocker arm and in a larger sense, the whole valvetrain.

While the invention has been shown and described in its preferred embodiments, it will be clear to those skilled in the arts to which it pertains that many changes and modifications can be made thereto without departing from the scope of the invention.

We claim:

1. An engine valvetrain including a pivotally mounted rocker arm engagable at one end with a movable valve stem member for actuating the same, engine camshaft cam actuated means in contact with another portion of the rocker arm for pivoting the rocker arm at times in response to engine camshaft rotation, and a hydraulic lash adjusting assembly wholly contained within the rocker arm to continually compensate for any gradual relative displacement between the parts of the valvetrain, the assembly including a high pressure enclosed fluid chamber connected to a low pressure fluid reservoir having a gas spring wholly contained therein, and with the chamber containing a piston, a spring biasing the piston against the cam actuated means, and a one-way ball type check valve connecting the chamber and reservoir unseatable to supply makeup fluid to the chamber and seatable to establish movement of the rocker arm essentially concurrent with movement of the piston by the cam actuated means, the chamber and reservoir being spaced on opposite sides of the rocker arm shaft to minimize the overall width and rotational moment of inertia of the valvetrain.

2. A valvetrain as in claim 1, wherein the lash adjusting assembly is self-contained, the reservoir being sealed.

3. A valvetrain as in claim 1, including means connecting the reservoir to a source of pressurized fluid maintaining the reservoir at a low pressure level while directing minimal leakage of fluid past the high pressure piston to the engine in response to movement of the piston by the cam actuated means.

4. A valvetrain as in claim 1, wherein the reservoir is separated and spaced from the high pressure chamber and connected thereto by passage means, the high pressure chamber and reservoir being essentially radially located with respect to the rocker arm pivot axis and close thereto concentrating the mass thereof around the pivot.

5. A valvetrain as in claim 1, wherein the gas spring is a closed cell deformable gas spring foam member.

6. A valvetrain as in claim 1, wherein the gas spring is a sealed bellows member consisting of an expandable membrane enclosing a pair of essentially rigid plate members spaced apart by spring means.

* * * * *